US010466629B2

(12) United States Patent
Murasaki et al.

(10) Patent No.: US 10,466,629 B2
(45) Date of Patent: Nov. 5, 2019

(54) FIXING DEVICE AND IMAGE FORMING APPARATUS

(71) Applicant: CANON KABUSHIKI KAISHA, Tokyo (JP)

(72) Inventors: Satoshi Murasaki, Numazu (JP); Motoyasu Muramatsu, Susono (JP); Hiroki Eguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/135,909

(22) Filed: Sep. 19, 2018

(65) Prior Publication Data

US 2019/0094766 A1 Mar. 28, 2019

(30) Foreign Application Priority Data

Sep. 28, 2017 (JP) ..... 2017-189097

(51) Int. Cl.
*G03G 15/20* (2006.01)
*G03G 15/08* (2006.01)

(52) U.S. Cl.
CPC ..... *G03G 15/2025* (2013.01); *G03G 15/0891* (2013.01); *G03G 15/2017* (2013.01); *G03G 15/2064* (2013.01); *G03G 2215/2035* (2013.01)

(58) Field of Classification Search
CPC ..... G03G 15/0891; G03G 15/2025; G03G 15/2064
See application file for complete search history.

(56) References Cited

U.S. PATENT DOCUMENTS

| | | | | |
|---|---|---|---|---|
| 8,131,197 | B2 * | 3/2012 | Hiraoka | G03G 15/206 399/329 |
| 2014/0212189 | A1 * | 7/2014 | Kondo | G03G 15/2053 399/329 |
| 2018/0196376 | A1 * | 7/2018 | Mizuno | G03G 15/1615 |

FOREIGN PATENT DOCUMENTS

| | | | |
|---|---|---|---|
| EP | 2853956 | A1 | 4/2015 |
| JP | 2008197637 | A | 8/2008 |
| JP | 2011248285 | A | 12/2011 |
| JP | 2015028527 | A | 2/2015 |
| JP | 2015069124 | A | 4/2015 |
| JP | 2016148816 | A | 8/2016 |
| JP | 2017009949 | A | 1/2017 |

* cited by examiner

*Primary Examiner* — Gregory H Curran
(74) *Attorney, Agent, or Firm* — Canon U.S.A., Inc. IP Division

(57) ABSTRACT

In a fixing device of the present invention, first and second movable members are each urged toward a flexible member so that the contact between contact surfaces of the first and second movable members and end faces of the flexible member are each maintained.

5 Claims, 15 Drawing Sheets

FIXING DEVICE AND IMAGE FORMING APPARATUS

BACKGROUND OF THE INVENTION

Field of the Invention

The present invention relates to a fixing device that fixes a toner image to a recording material, and an image forming apparatus using a recording method such as an electrophotographic recording method or an electrostatic recording method in which the fixing device is mounted.

Description of the Related Art

A film-type fixing device using a tubular film as a member for conveying a recording material on which an unfixed toner image is formed is known. Since the heat capacity of this type of fixing device can be reduced, there is an advantage that power consumption can be suppressed.

In film-type fixing devices, there is a problem that the end faces of the film are easily broken, and various countermeasures have been proposed (Japanese Patent Laid-Open No. 2015-028527).

A lubricant such as oil or grease can be applied to the inner surface of the film so as to reduce both fluctuation in the rotational torque of the film and abrasion. However, the lubricant sometimes protrudes from the openings at the ends the tubular film, and there is a problem that the image forming apparatus and the recording material can be contaminated by the lubricant.

The present invention provides a fixing device capable of suppressing a lubricant from protruding from the openings at the ends of a tubular film.

SUMMARY OF THE INVENTION

In an aspect of the present invention, a fixing device includes a tubular flexible member, a first movable member disposed so as to face a first end face of the tubular flexible member and having a contact surface arranged to contact the first end face of the flexible member, and a second movable member disposed so as to face a second end face of the tubular flexible member and having a contact surface arranged to contact the second end face of the tubular flexible member. The flexible member is arranged to contact and convey a recording material bearing an unfixed image while the recording material is subjected to a fixing process. The first and second movable members are each urged toward the flexible member so that the contact between the contact surfaces of the first and second movable members and the end faces of the flexible member are each maintained.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

DESCRIPTION OF THE EMBODIMENTS

First Embodiment

Figure 1:
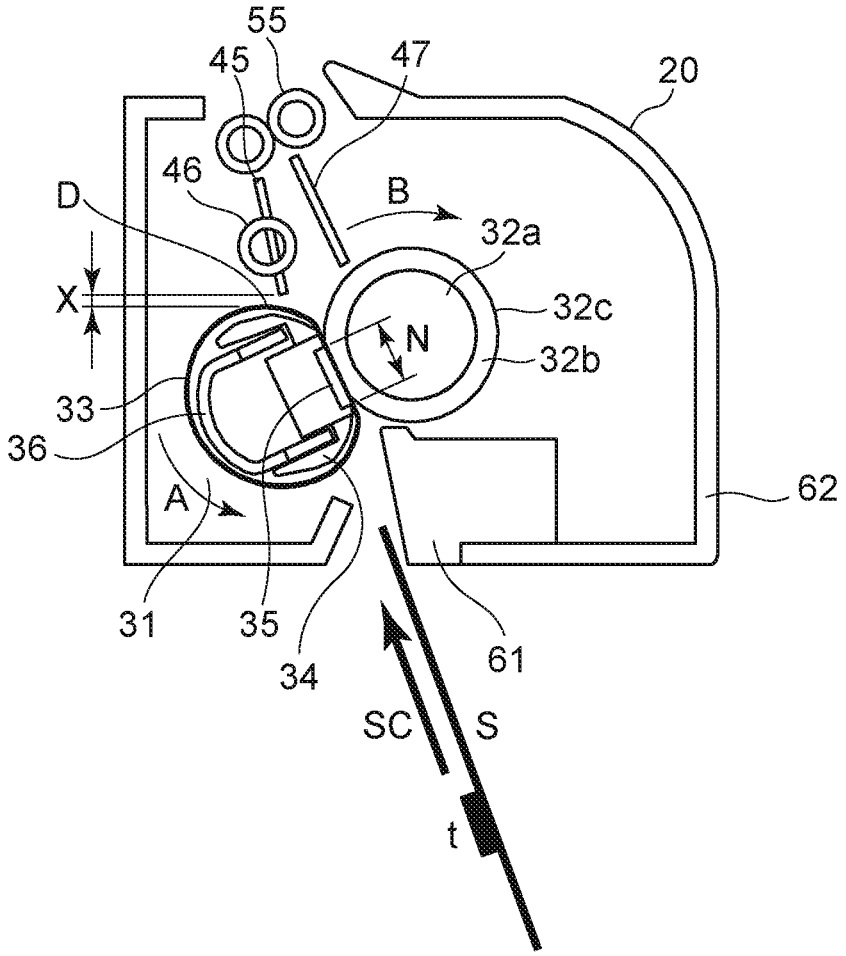
FIG. 1 is a sectional view of a fixing unit.
Figure 2:
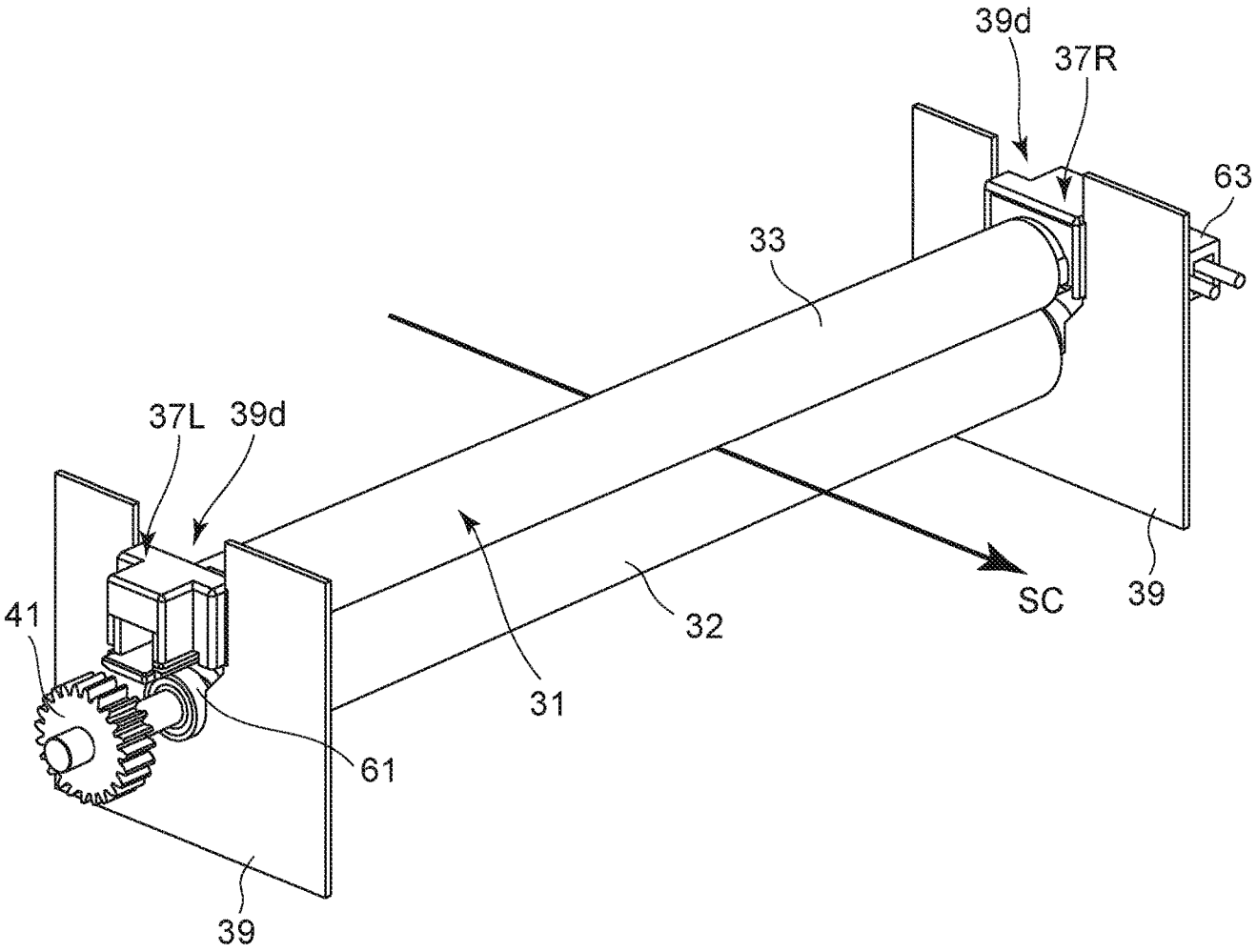
FIG. 2 is a perspective view of a fixing unit.
Figure 3:
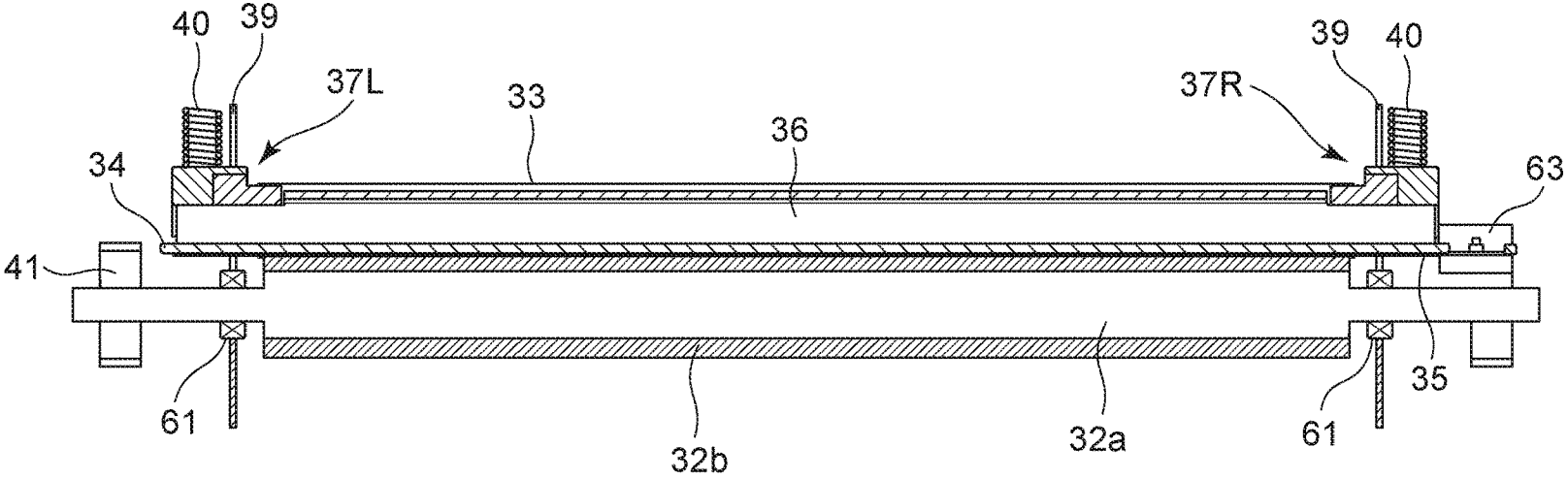
FIG. 3 is a sectional view of a fixing unit according to a first embodiment as viewed from the downstream side in the recording material conveying direction.

A first embodiment of the present invention will be described below. First, the outline of a fixing unit (fixing device) common to all embodiments will be described with reference to FIGS. 1 to 3. FIG. 1 is a sectional view of the fixing unit 20, FIG. 2 is a perspective view of a film assembly 31 and a pressure roller 32 provided inside the fixing unit 20, and FIG. 3 is a sectional view of the film assembly 31 and the pressure roller 32 as viewed from the downstream side in the recording material conveying direction.

The fixing unit 20 includes the film assembly 31, the pressure roller 32, a conveying roller 55, a sheet conveying guide portion 61, and an outer casing portion 62. Reference numeral 31 denotes the film assembly as a first fixing member, reference numeral 32 denotes the pressure roller as a second fixing member, and a fixing nip portion N is formed by applying pressure between them.

The film assembly 31 includes a tubular fixing film (flexible member) 33, a heater 35, a heater holder 34 for holding the heater 35, and a stay 36 for securing the rigidity of the film assembly 31. The heater holder 34 also has a role of guiding the rotation of the film 33. The heater 34 generates heat by being supplied with power through a connector 63. The material of the film 33 can be a metal such as stainless steel or a heat-resistant resin such as polyimide. In the film 33 of this embodiment, a base layer is made of stainless steel, and a silicone rubber layer (intermediate layer) and a fluororesin layer (surface layer) are provided on the outer periphery thereof. The heater 35 is formed by printing a heat generating resistor made of silver-palladium or the like on a substrate made of ceramic such as alumina or aluminum nitride. The material of the heater holder 34 is a heat-resistant resin, and in this embodiment, LCP (Liquid Crystal Polymer) is used. The material of the stay 36 is a metal, and in this embodiment, a galvanized steel plate (iron) is used. The heater 35 is in contact with the inner surface of the film 33, and the film 33 rotates while being in contact with the heater 35. A lubricant is applied to the inner surface of the film 33. The film assembly 31 further includes a first regulating unit 37R and a second regulating unit 37L for regulating the lateral shift movement in the film generatrix direction when the film 33 is rotating. The first regulating unit 37R is disposed so as to face a first end face of the film 33 in the generatrix direction of the film 33, and the second regulating unit 37L is disposed so as to face a second end face of the film 33 in the generatrix direction of the film 33. The first and second regulating units 37R and 37L also have roles of regulating the rotational loci of the ends of the film 33 in the film generatrix direction.

The pressure roller 32 includes a core metal 32*a*, an elastic layer 32*b* of silicone rubber or the like, and a fluororesin layer 32*c* of PTFE (polytetrafluoroethylene), PFA (tetrafluoroethylene-perfluoroalkyl vinyl ether copolymer), FEP (tetrafluoroethylene-hexafluoropropylene copolymer), or the like. As shown in FIG. 2, a gear 41 is provided at an end of the pressure roller 32, and the motive power from a motor provided in the image forming apparatus main body is transmitted to the pressure roller 32 through the gear 41. The film 33 is driven to rotate by the rotation of the pressure roller 32.

The pressure roller 32 is held by frames 39 of the fixing unit 20 via bearings 61. The frames 39 are made of metal, and most of their surfaces are covered by the outer casing portion 62 made of a heat-resistant resin. The regulating units 37R and 37L are also held by the frames 39. As shown in FIG. 3, when the regulating units 37R and 37L are urged toward the pressure roller 32 by pressurizing springs 40, pressure is applied to the pressure roller 32 via the stay 36, the heater holder 34, the heater 35, and the film 33. By the application of pressure between the film assembly 31 and the pressure roller 32, a fixing nip portion N for nipping and conveying a recording material S on which an unfixed toner image t is formed in the direction SC is formed. The fixing unit 20 fixes the unfixed image on the recording material conveyed while being in contact with the film 33 to the recording material in the fixing nip portion N.

Figure 15:
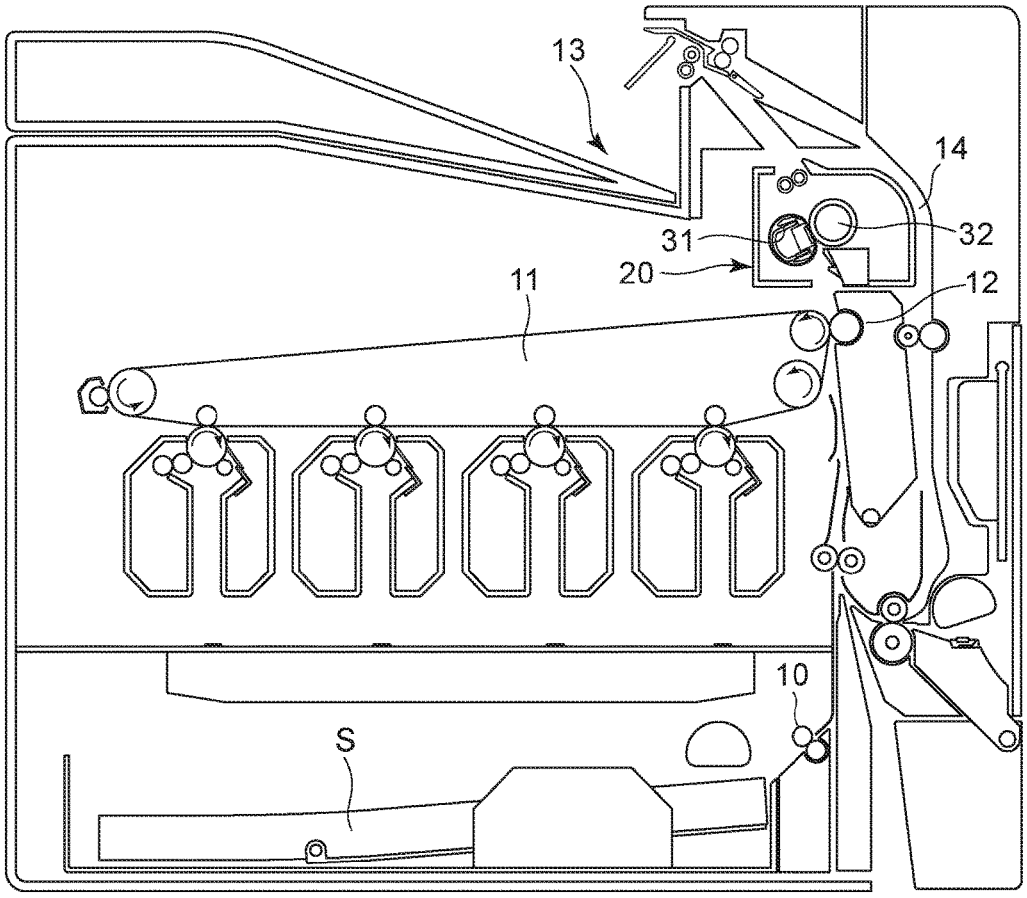
FIG. 15 is a sectional view of an image forming apparatus.

Next, the outline of the image forming apparatus including the fixing unit 20 will be described with reference to FIG. 15. The image forming apparatus shown in FIG. 15 is a laser printer using an electrophotographic recording method. Since the electrophotographic recording method is a well-known technique, the explanation of the image forming process will be largely omitted.

A toner image formed by an image forming portion 11 is transferred to a recording material S fed from a paper feeding portion 10, in a transfer portion 12. Thereafter, the recording material S bearing the unfixed toner image is subjected to the fixing process in the fixing unit 20 and discharged to a tray 13. In the case of the duplex print mode, the recording material S whose first side has been subjected to the fixing process is switchbacked before being discharged to the tray 13, and the trailing edge of the recording material S is thereby switched to the leading edge. Thereafter, the recording material S is conveyed again to the transfer portion 12 through a duplex conveying path 14, and an image is thereby formed on the second side of the recording material S. After being subjected to the fixing process in the fixing unit 20, the recording material S is discharged to the tray 13.

Next, the configurations of the first and second regulating units 37R and 37L will be described with reference to FIGS. 4A to 6. Since the configuration of the second regulating unit 37L is substantially the same as that of the first regulating unit 37R, these configurations will be described using the first regulating unit 37R.

Figure 4A:
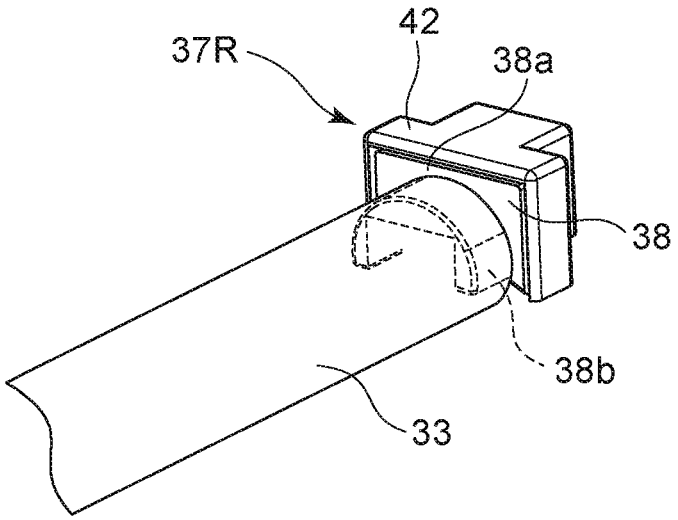
FIG. 4A is a perspective view of the vicinity of a regulating unit.
Figure 4B:
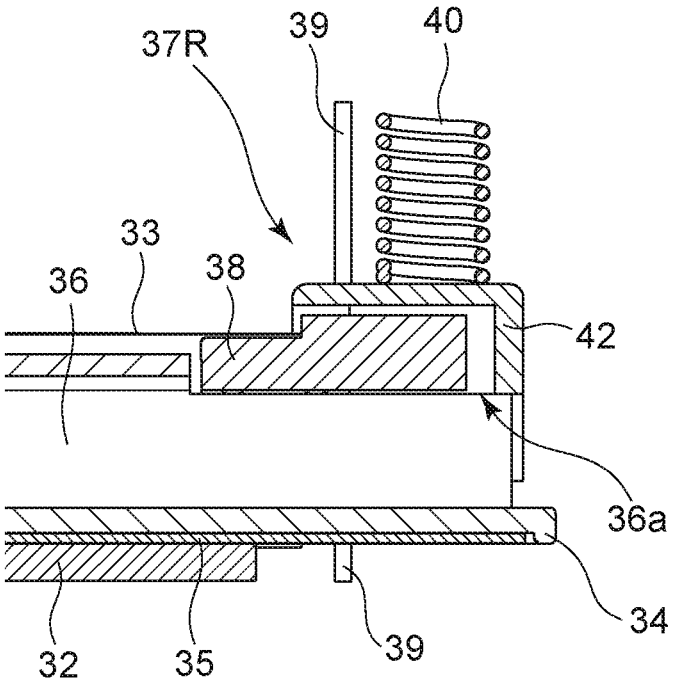
FIG. 4B is a sectional view thereof.
Figure 5A:
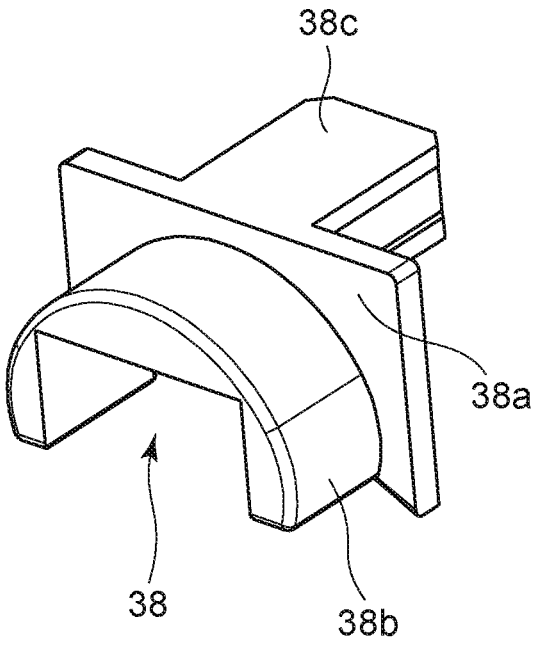
FIG. 5A is a perspective view of a movable member.
Figure 5B:
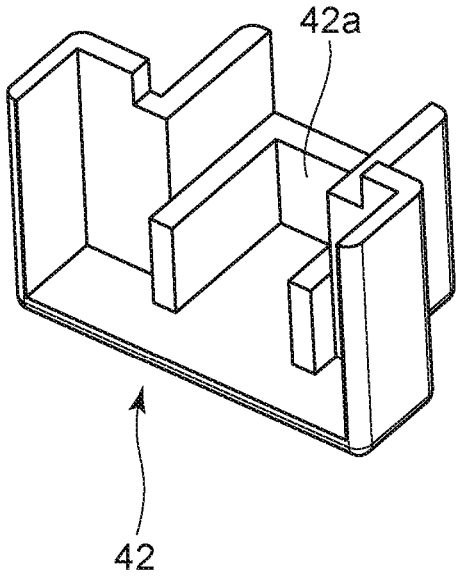
FIG. 5B is a perspective view of a holding member.
Figure 6:
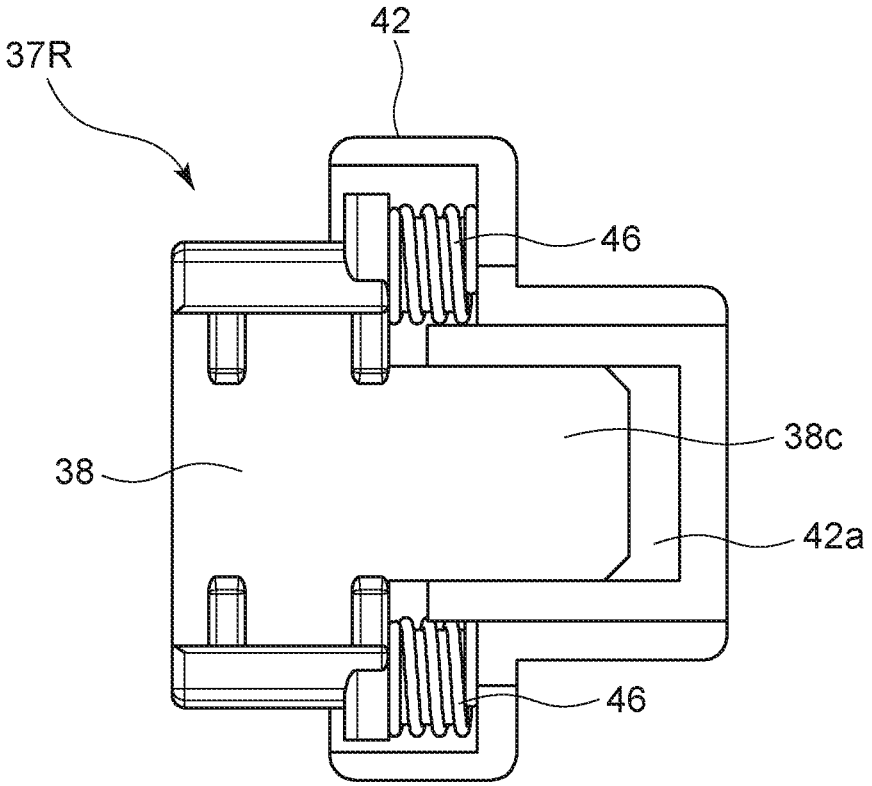
FIG. 6 is a view showing the regulating unit of the first embodiment in an assembled state.

FIG. 4A is a perspective view of the vicinity of the first regulating unit 37R, and FIG. 4B is a sectional view of the first regulating unit 37R. FIG. 5A is a perspective view of a movable member 38 described later, and FIG. 5B is a perspective view of a holding member 42 described later. FIG. 6 is a view of the first regulating unit 37R, which is a combination of a holding member 42 and a movable member 38, as viewed from the pressure roller 32 side.

As shown in FIGS. 5A, 5B, and 6, the first regulating unit 37R includes a movable member 38, a holding member 42 that holds the movable member 38, and urging members (first urging members) 46 that urge the movable member 38 in the film generatrix direction. The second regulating unit 37L also includes a movable member 38, a holding member 42, and urging members (second urging members) 46. The holding member 42 is slid and inserted into a groove 39*d* (see FIG. 2) of the frame 39. The holding member 42 is urged by the pressurizing spring 40 with a large force. Therefore, the holding member 42 is substantially fixed to the frame 39 unless the urging by the pressurizing spring 40 is released. The movement of the holding member 42 at least in the film generatrix direction and the recording material conveying direction is regulated by the frame 39.

On the other hand, the movable member 38 is a member that moves following the lateral shift movement of the film 33 by the urging force of the urging members 46 (occasionally against the urging force of the urging members 46). The movable member 38 is arranged with a slight clearance in the pressing direction of the pressurizing spring 40 between the movable member 38 and the upper end 36*a* of the end portion of the stay 36 in the film generatrix direction. The holding member 42 is in contact with the upper end 36*a* of the stay 36 in the pressing direction of the pressurizing spring 40 and is arranged with a slight clearance between the holding member 42 and the upper part of the movable member 38.

The movable member 38 has a regulating surface (a contact surface with which the end face of the film 33 contacts) 38*a* against which the end face of the film 33 abuts, and an inner surface facing portion 38*b* that is in contact with the inner surface of the end portion of the film 33 in the film generatrix direction and guides the rotation of the film 33. Alignment of both end portions of the film in the recording material conveying direction is prevented from being shifted with respect to the pressure roller 32 by the inner surface facing portions 38*b* of the first and second movable members 38. As described above, the first movable member 38 has the contact surface 38*a* with which the first end face of the film 33 in the film generatrix direction is in contact, and is disposed so as to face the first end face of the film 33. Similarly, the second movable member 38 has a contact surface 38*a* with which the second end face of the film 33 in the film generatrix direction is in contact, and is disposed so as to face the second end surface of the film 33.

The movable member 38 has a rib portion 38*c* that is parallel to the film generatrix direction. The holding member 42 is provided with a guide groove 42*a* into which the rib portion 38*c* of the movable member 38 is inserted. Since the rib portion 38*c* is guided by the guide groove 42*a*, the movable member 38 is held slidably in the film generatrix direction with respect to the holding member 42. Between the holding member 42 and the movable member 38, compression springs (urging members) 46 for urging the movable member 38 in the film generatrix direction are provided. As will be described later, both when the film is laterally shifted to one side in the generatrix direction and when the film is laterally shifted to the other side, the contact between the contact surface of the first movable member and the first end face of the film and the contact between the contact surface of the second movable member and the second end face of the film are both maintained. Both the first movable member and the second movable member are urged in the generatrix direction so that these contacts are maintained.

Figure 7A:
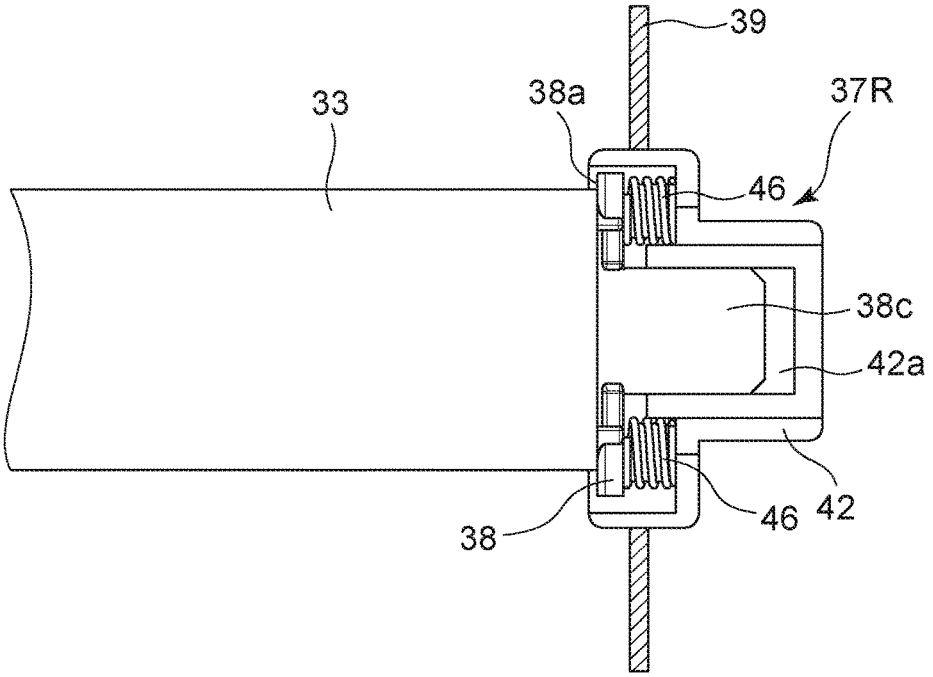
FIGS. 7A and 7B are diagrams showing the movement of the movable member.
Figure 7B:
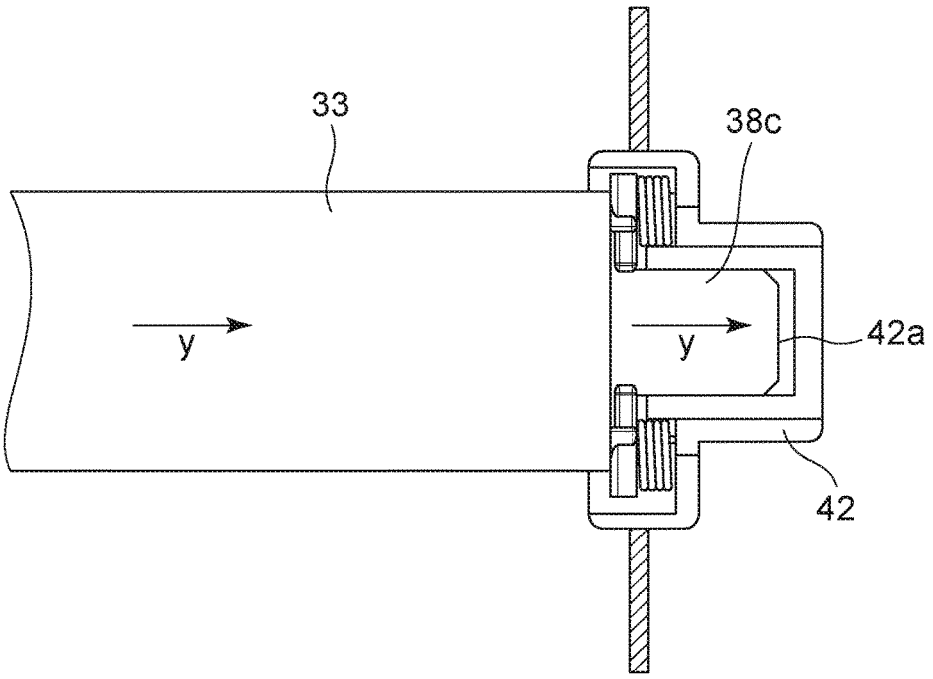

Next, the operation of the first regulating unit 37R will be described with reference to FIGS. 7A and 7B. The operation of the second regulating unit 37L is also the same. FIGS. 7A and 7B are views of the first regulating unit 37R as viewed from the pressure roller 32 side.

FIG. 7A shows a state in which the end face (first end face) of the film 33 is pressed by the first movable member 38, and the contact between the first end face of the film 33 and the regulating surface 38*a* of the first movable member 38 is maintained. At this time, the contact between the second end face of the film 33 and the regulating surface 38*a* of the second movable member 38 is also maintained. The urging forces of the first and second regulating units 37R and 37L are balanced so that the film 33 is positioned substantially at the midpoint between the first and second regulating units 37R and 37R.

FIG. 7B shows a state in which, when the film 33 rotates, the film 33 is laterally shifted to the right due to sonic factor (for example, relative misalignment between the pressure roller 32 and the film 33), and further presses the first movable member 38 rightward in the figure. At this time also, the contact between the second end face of the film 33 and the regulating face 38*a* of the second movable member 38 is maintained. When the film 33 moves from the state of being moved rightward toward the center, the movable member 38 follows the movement of the film 33 and returns to the position shown in FIG. 7A so as to maintain the contact state between the first end face and the regulating surface of the first movable member 38.

Figure 8A:
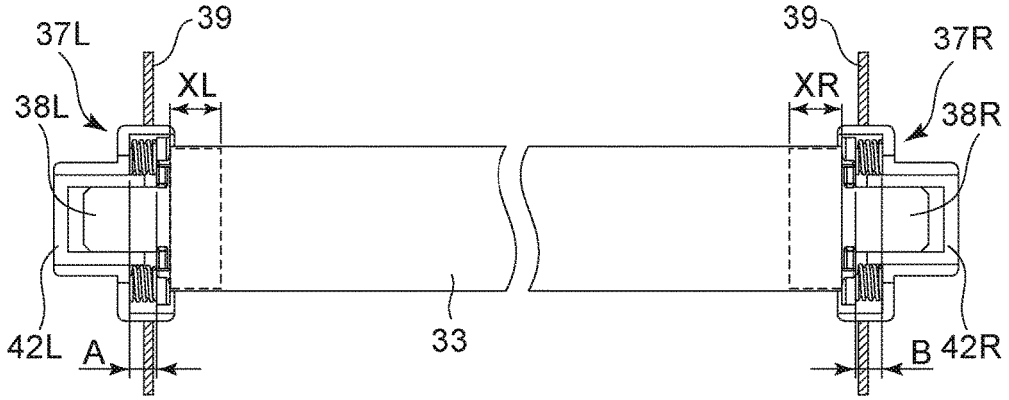
FIGS. 8A and 8B are diagrams showing the relationship between two movable members and a film.
Figure 8B:
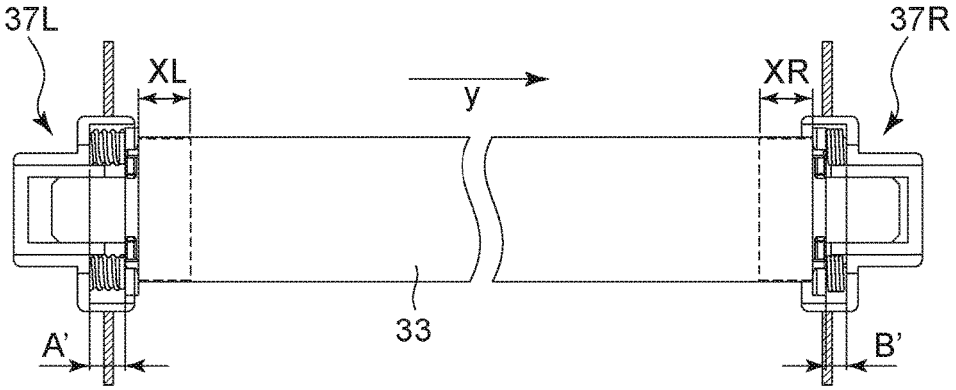

Next, with reference to FIGS. 8A and 8B, the positional relationship between the movable members 38 at both ends when the film 33 is laterally shifted to one side from the center will be described. FIGS. 8A and 8B are views of the nip portion between the film assembly 31 and the pressure roller 32 as viewed from the pressure roller 32 side. FIG. 8A shows a state in which the film 33 is located substantially at the midpoint between the first and second regulating units 37R and 37L (substantially at the midpoint between the two side plates 39). Since the film 33 is located substantially at the midpoint between the side plates 39, the distance B between the first movable member 38R and the first holding member 42R and the distance A between the second movable member 38L and the second holding member 42L are substantially equal to each other (A≈B). The regulating surfaces 38*a* of the first and second movable members 38R and 38L are in contact with the two end faces of the film 33.

FIG. 8B shows a state in which the film 33 is shifted rightward (in the y direction), for example, relative misalignment between the pressure roller 32 and the film 33. Due to the shift of the film 33 to the right, the first movable member 38R moves to the right, and the second movable member 38L on the side opposite to the shifting direction also moves to the right following the lateral shift movement of the film 33. Therefore, the distance B' between the first movable member 38R and the first holding member 42R is greater than the distance A' between the second movable member 38L and the second holding member 42L (A'<B'). Even in this state, the regulating surfaces 38*a* of the first and second movable members 38R and 38L are in contact with the two end faces of the film 33.

As described above, both when the film is laterally shifted to one side in the generatrix direction and when the film is laterally shifted to the other side, the contact between the contact surface of the first movable member and the first end face of the film and the contact between the contact surface of the second movable member and the second end face of the film are both maintained. Both the first movable member and the second movable member are urged in the generatrix direction so that these contacts are maintained. Therefore, even when a lubricant is applied to the inner surface of the film, the lubricant can be prevented from protruding out of the film.

In FIGS. 8A and 8B, the length XR indicates the amount of insertion of the first movable member 38R with respect to the film 33 (the amount of overlap between the inner surface facing portion 38*b* of the first movable member 38R and the film 33 in the film generatrix direction). The length XL indicates the amount of insertion of the second movable member 38L with respect to the film 33 (the amount of overlap between the inner surface facing portion 38*h* of the second movable member 38L and the film 33 in the film generatrix direction). Since both end faces of the film 33 and the two regulating surfaces 38*a* are always in contact with each other, the amount of insertion of the first movable member 38R with respect to the film 33 is XR and has not changed in both the case of FIG. 8A and the case of FIG. 8B. Similarly, the amount of insertion of the second movable member 38L with respect to the film 33 is XL and has not changed in both the case of FIG. 8A and the case of FIG. 8B. When the length of the inner surface facing portion 38*b* of the first movable member 38R in the film generatrix direction is equal to the length of the inner surface opposing portion 38*b* of the second movable member 38L, XR and XL are also equal.

Thus, regardless of the laterally shifted state of the film 33, the amount of insertion XR of the first movable member 38R with respect to the film 33 and the amount of insertion XL of the second movable member 38L with respect to the film 33 can both be kept constant. As a result, even when the film 33 is shifted to one side or when the end portion of the film wears and the longitudinal dimension of the film becomes short, the amount of insertion of the movable member 38 with respect to the film 33 can surely be secured. Therefore, it is possible to prevent the film 33 from being detached from the regulating unit 37 and damaged.

Second Embodiment

A second embodiment will now be described. The same components as those described in the first embodiment are denoted by the same reference numerals, and the description thereof is omitted.

Figure 9A:
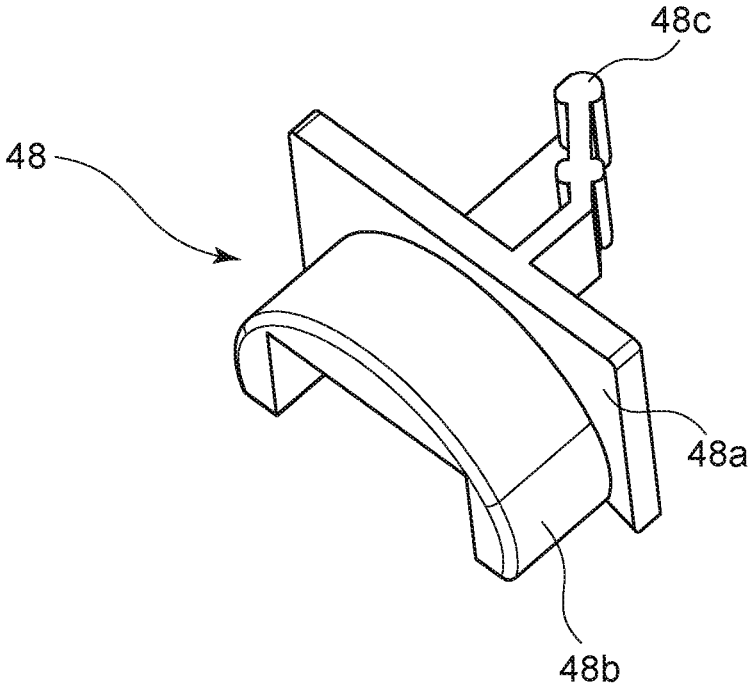
FIG. 9A is a perspective view of a movable member of a second embodiment.

First, the configuration of the regulating unit 47 in this embodiment will be described with reference to FIGS. 9A to 10. FIG. 9A is a perspective view of a first movable member 48, FIG. 9B is a perspective view of a holding member 49, and FIG. 10 is a view of a first regulating unit 47R that is a combination of the holding member 49 and the first movable member 48 as viewed from the pressure roller 32 side.

Figure 9B:
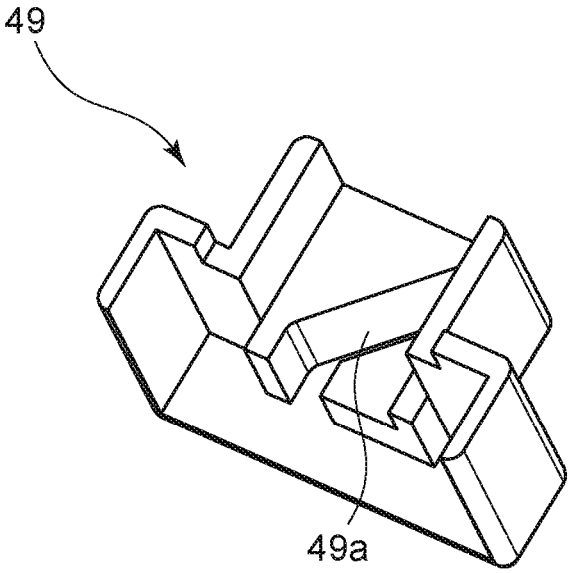
FIG. 9B is a perspective view of a holding member of the second embodiment.
Figure 10:
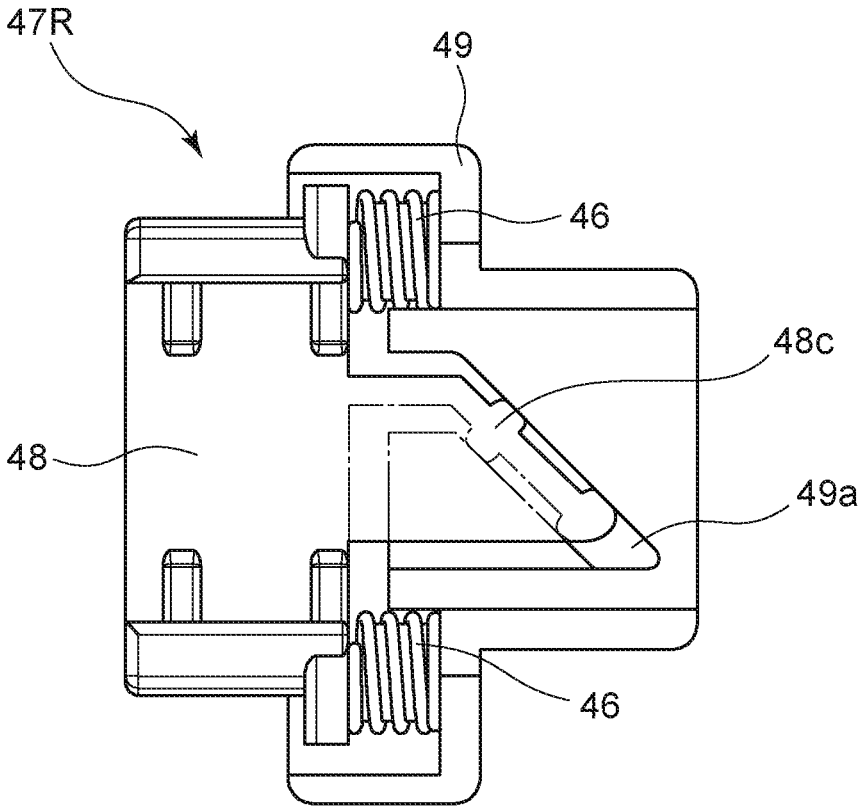
FIG. 10 is a view showing a regulating unit of the second embodiment in an assembled state.

As shown in FIGS. 9A, 9B, and 10, the first movable member 48 is provided with a regulating surface (contact surface) 48*a*, an inner surface facing portion 48*b*, and a protruding portion 48*c* that is inclined with respect to the generatrix direction (longitudinal direction) of the film 33. The holding member 49 is provided with a groove portion 49*a* for guiding the protruding portion 48*c*, and the groove portion 49*a* is also inclined with respect to the generatrix direction of the film 33. Since the protruding portion 48*c* is guided by the groove portion 49*a*, the movable member 48 is held slidably with respect to the holding member 49.

Figure 11A:
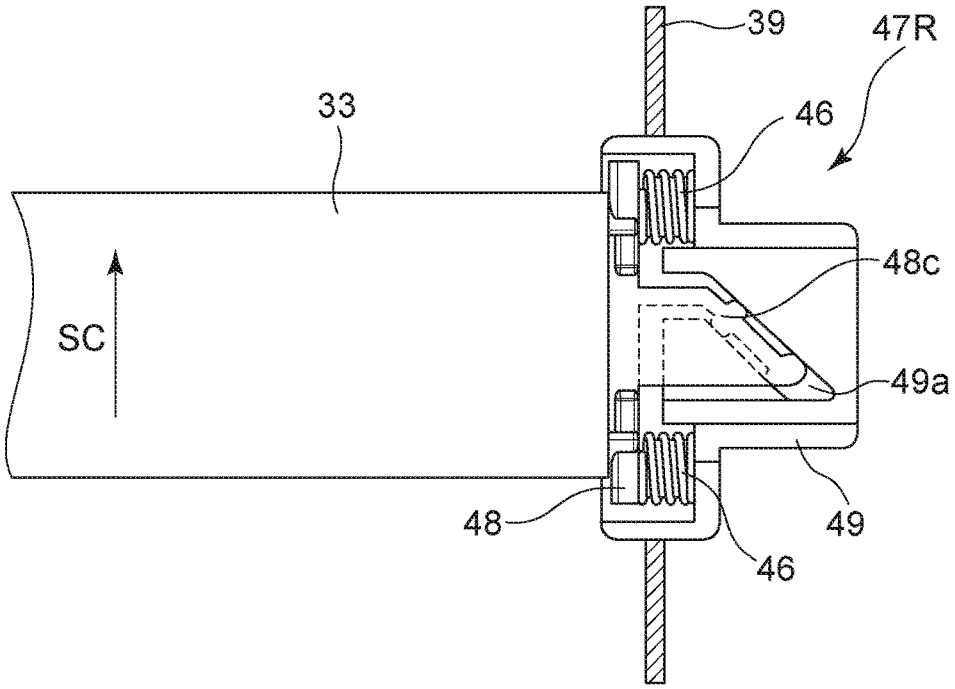
FIGS. 11A and 11B are diagrams showing the movement of the movable member.
Figure 11B:
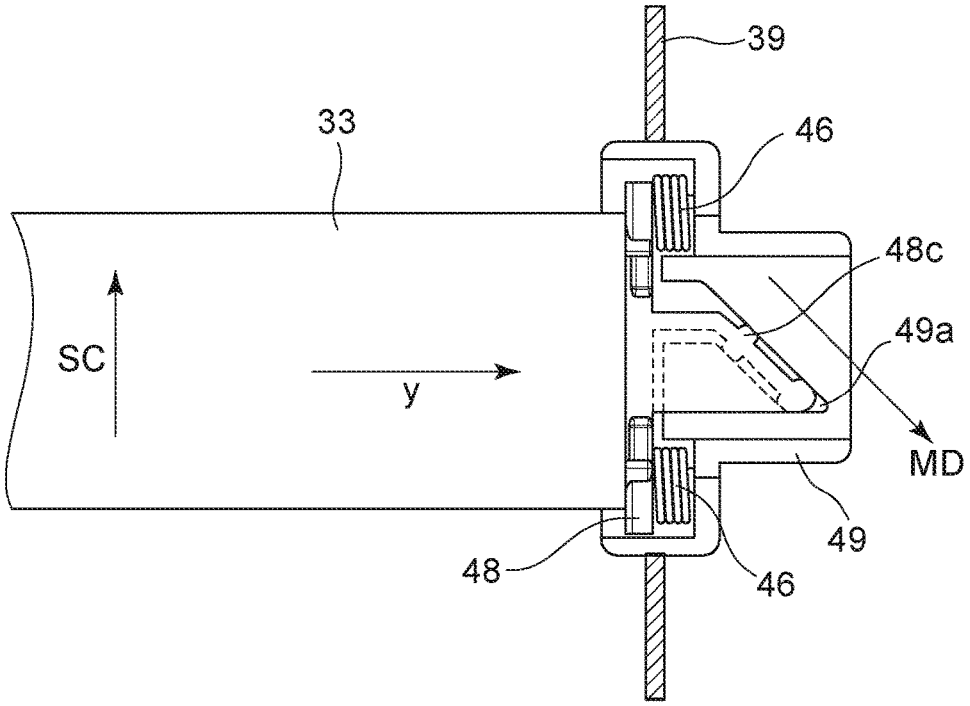

Next, the operation of the first regulating unit 47R will be described with reference to FIGS. 11A and 11B. The operation of the second regulating unit 47L is also the same. FIGS. 11A and 11B are views of the first regulating unit 47R as viewed from the pressure roller 32 side.

FIG. 11A shows a state in which the end face (first end face) of the film 33 is pressed by the first movable member 48 and the contact between the first end face of the film 33 and the regulating surface 48*a* of the first movable member 48 is maintained. At this time, the contact between the second end face of the film 33 and the regulating surface 48*a* of the second movable member 48 is also maintained. The urging forces of the first and second regulating units 47R and 47L are balanced so that the film 33 is positioned substantially at the midpoint between the first and second regulating units 47R and 47R.

FIG. 11B shows a case in which the film 33 is laterally shifted rightward (in the y direction). At this time, since the film 33 presses the regulating surface 48*a* of the first movable member 48, the first movable member 48 moves in the direction of the arrow MD. That is, the first movable member 48 moves in the direction opposite to the recording material conveying direction (it moves toward the upstream in the recording material conveying direction SC).

Figure 12A:
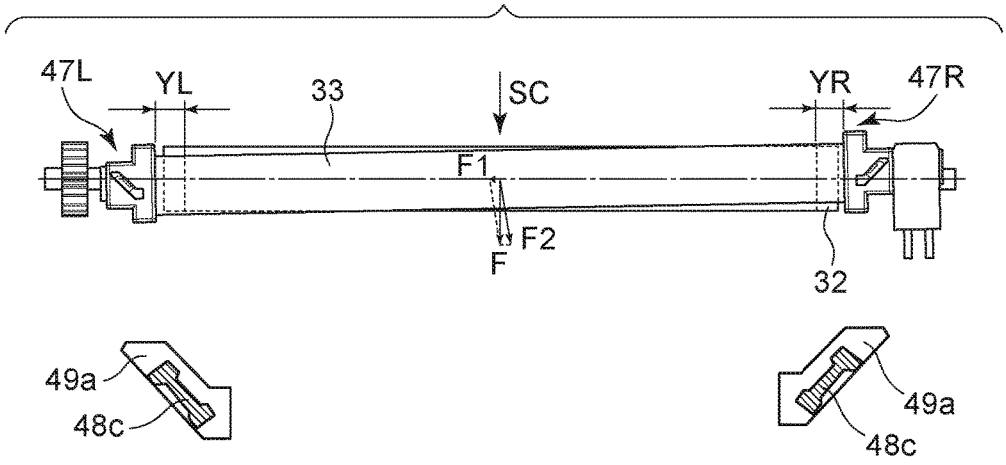
FIGS. 12A and 12B are diagrams showing the relationship between two movable members and a film.
Figure 12B:
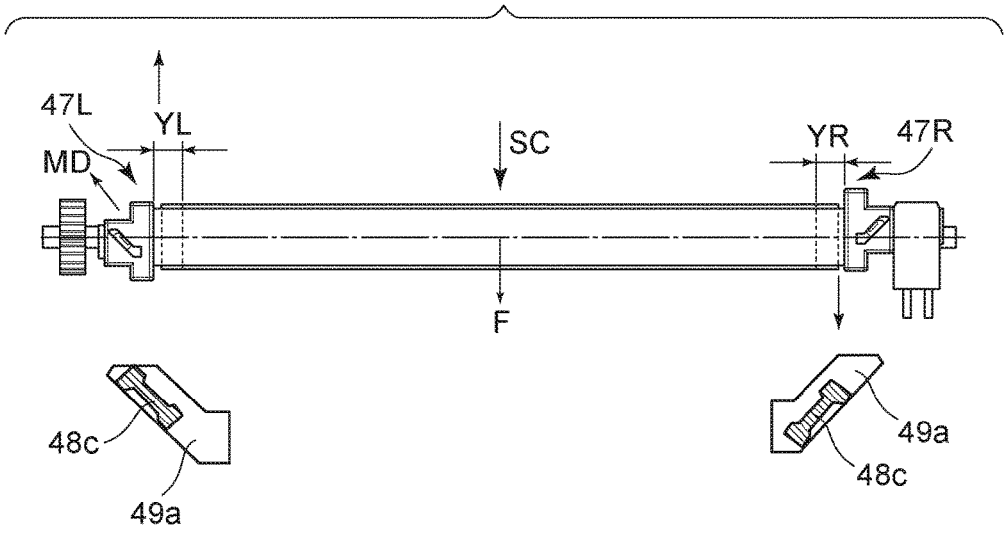

Next, the principle of reducing the stress applied to the end face of the film 33 will be described with reference to FIGS. 12A and 12B. FIGS. 12A and 12B are views of the contact portion between the film assembly 31 and the pressure roller 32 as viewed from the film 33 side. What is shown at the bottom of each figure is an enlarged view of the protruding portion 48*c* and the groove portion 49*a*.

Generally, the cause of the lateral shift movement of the film 33 is the misalignment between the pressure roller 32 and the film 33. FIG. 12A shows a state in which the second regulating unit 47L side end of the film 33 is inclined to the downstream side in the recording material conveying direction with respect to the axis of the pressure roller 32, and the first regulating unit 47R side end of the film 33 is inclined to the upstream side in the recording material conveying direction with respect to the axis of the pressure roller 32. As shown in FIG. 12A, the film 33 is subjected to a force F due to the rotation of the pressing roller 32. The force F can be resolved into a force F1 in the generatrix direction (longitudinal direction) of the film 33 and a force F2 in a direction orthogonal thereto. The film 33 is laterally shifted due to the force F1 along the longitudinal direction of the film 33. In the case of FIG. 12A, the film 33 is laterally shifted to the second regulating unit 47L side. When the film 33 presses the second movable member 48, the second movable member 48 is guided by the groove portion 49*a* of the holding member 49 and moves to the upstream side in the recording material conveying direction (MD direction). The first movable member 48 on the side opposite to the side to which the film 33 has shifted moves to the second regulating unit 47L, side following the movement of the film 33. During this movement, the first movable member 48 moves along the groove portion 49*a* of the holding member 49, so that the first movable member 48 moves to the downstream side in the recording material conveying direction. During the movement of the first movable member 48, the regulating surface 48*a* is also in contact with the end face of the film 33.

Along with the movement of the first and second movable members 48, the film 33 is pushed by the inner surface facing portions 48*b* of the first and second movable members 48. Then, as shown in FIG. 12B, the second movable member 48 side of the film 33 moves to the upstream side in the recording material conveying direction, and the first movable member 48 side of the film 33 moves to the downstream side in the recording material conveying direction. As described above, the posture of the film 33 is inclined in a direction to cancel the lateral shift movement, whereby the relative misalignment between the pressure roller 32 and the film 33 is corrected, and the relative angle between the force F and the longitudinal direction of the film 33 changes in a direction to reduce film shift. As a result, the magnitude of the force F1 is reduced, and the stress applied to the end face of the film 33 is also reduced.

Also in FIGS. 12A and 12B, both when the film is laterally shifted to one side in the generatrix direction and when the film is laterally shifted to the other side, the contact between the contact surface of the first movable member and the first end face of the film and the contact between the contact surface of the second movable member and the second end face of the film are both maintained. Both the first movable member and the second movable member are urged in the generatrix direction so that these contacts are maintained. Therefore, even when a lubricant is applied to the inner surface of the film, the lubricant can be prevented from protruding out of the film.

The amount of insertion of the first movable member 48 with respect to the film 33 is YR and has not changed in both the case of FIG. 12A and the case of FIG. 12B. Similarly, the amount of insertion of the second movable member 48 with respect to the film 33 is YL and has not changed in both the case of FIG. 12A and the case of FIG. 12B, When the length of the inner surface facing portion 48*b* of the first movable member 48 in the film generatrix direction is equal to the length of the inner surface opposing portion 48*b* of the second movable member 48, YR and YL are also equal.

Thus, regardless of the laterally shifted state of the film 33, the amount of insertion YR of the first movable member 48 with respect to the film 33 and the amount of insertion YL of the second movable member 48 with respect to the film 33 can both be kept constant. As a result, even when the film 33 is shifted to one side or when the end portion of the film wears and the longitudinal dimension of the film becomes short, the amount of insertion of the movable member 48 with respect to the film 33 can surely be secured. Therefore, it is possible to prevent the film 33 from being detached from the regulating unit 47 and damaged.

Next, a case where the user does not set the recording material at a predetermined position when setting the recording material on the cassette or the multi-tray will be described. This case is, for example, a case where the user does not move the regulating plate, which determines the position in the width direction (the direction orthogonal to the conveying direction) of the recording material, according to the width of the recording material, and the recording material is set inclined. In this case, the recording material is conveyed while being inclined, and a lateral shifting force greater than expected is applied to the film 33. Such a case will be described using the configuration of the second embodiment since the operation is the same in both of the configuration of the first embodiment and the configuration of the second embodiment.

Figure 13A:
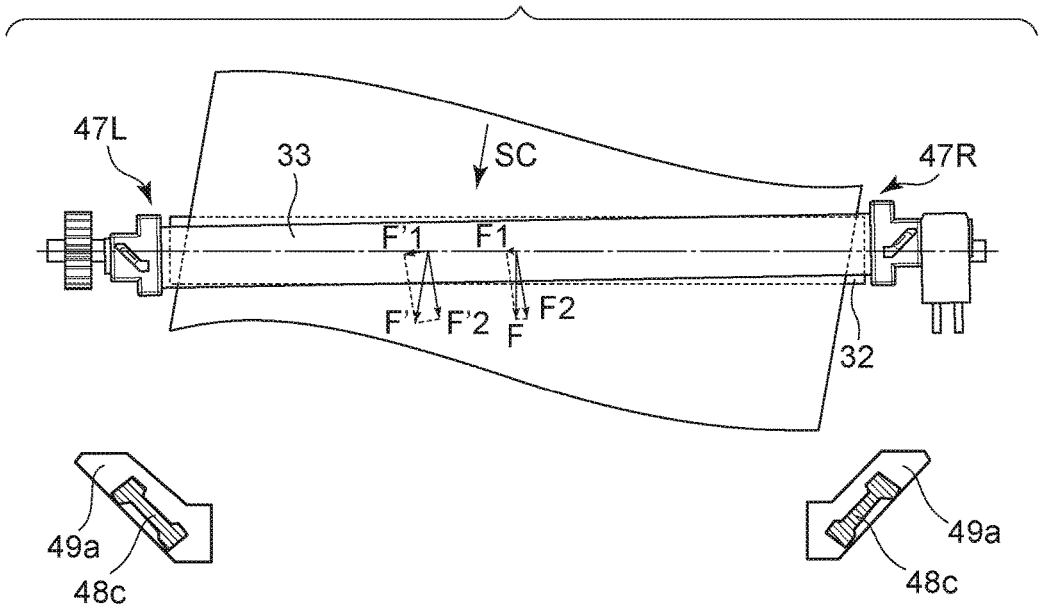
FIGS. 13A and 13B are diagrams showing the relationship between two movable members and a film in a state in which a recording material is conveyed while being inclined.
Figure 13B:
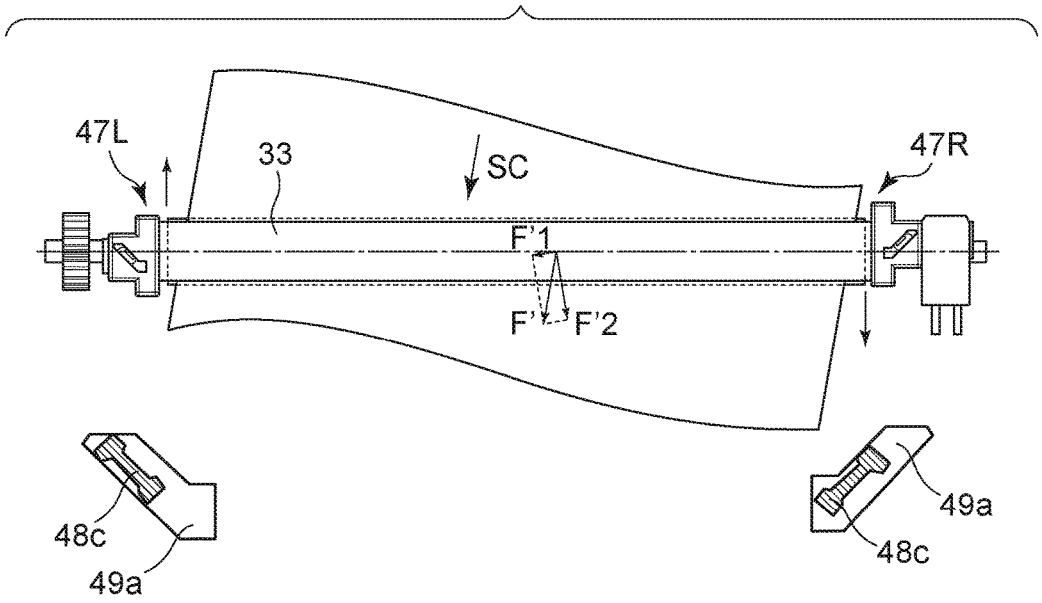
Figure 14:
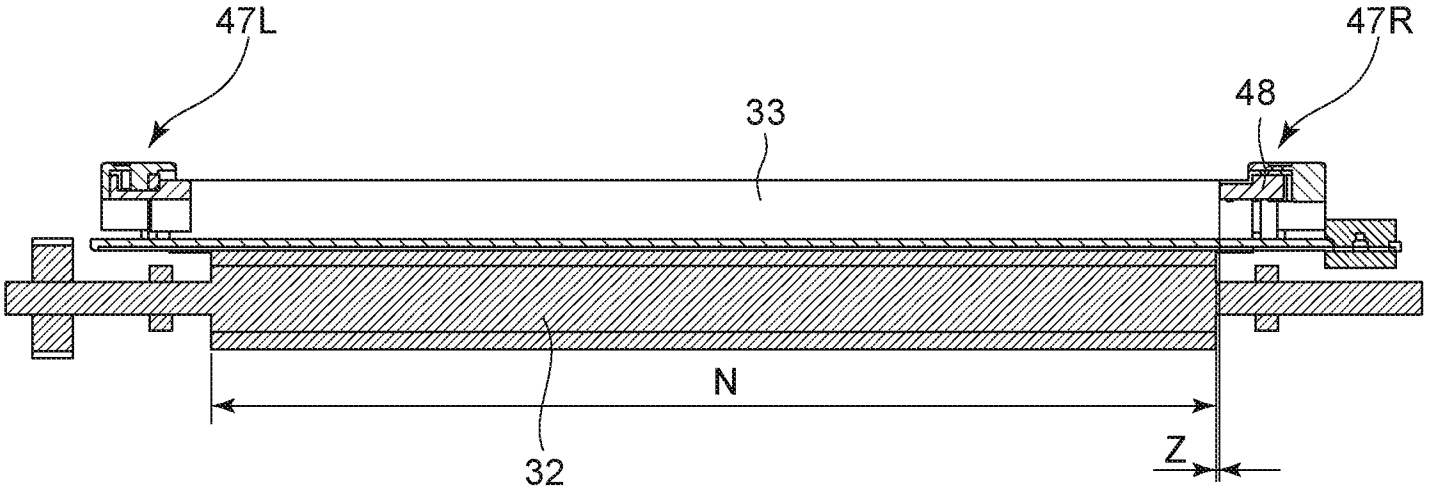
FIG. 14 is a diagram showing the positional relationship between a fixing nip portion and a movable member.

The operation of the regulating unit 47 when a lateral shifting force greater than expected is generated will be described with reference to FIGS. 13A to 14. FIGS. 13A and 13B are views of the contact portion between the film assembly 31 and the pressure roller 32 as viewed from the film 33 side, and FIG. 14 is a sectional view of the vicinity of the nip portion N between the film assembly 31 and the pressure roller 32 as viewed from the downstream side in the recording material conveying direction.

FIG. 13A shows a state in which the second regulating unit 47L side end of the film 33 is inclined to the downstream side in the recording material conveying direction with respect to the axis of the pressure roller 32, and the first regulating unit 47R side end of the film 33 is inclined to the upstream side in the recording material conveying direction with respect to the axis of the pressure roller 32, and the recording material S is being conveyed in a state of being rotated in the clockwise direction. As shown in FIG. 13A, the film 33 is subjected to a force F due to the rotation of the pressure roller 32 and a force F' due to the rotation of the recording material S. The force F can be resolved into a force F1 and a force F'1, and the force F' can be resolved into a force F2 and a force F'2. The film 33 is laterally shifted to the second regulating unit 47L side due to the force F1 and the force F'1 along the longitudinal direction of the film 33.

When the film 33 presses the second movable member 48, the second movable member 48 is guided by the groove portion 49*a* of the holding member 49 and moves to the upstream side in the recording material conveying direction. The first movable member 48 on the side opposite to the shifting direction moves to the second regulating unit 47L side following the movement of the film 33 and therefore is guided by the groove portion 49*a* of the holding member 49 and moves to the downstream side in the recording material conveying direction.

However, since the lateral shifting force (F1+F'1) greater than expected is applied to the film 33, as shown in FIG. 13B, even if the second movable member 48 side end of the film 33 moves to the upstream side in the conveyance direction and the first movable member 48 side end moves to the downstream side, the lateral shifting force cannot be canceled. The amount of inclination of the film 33 enough to cancel the lateral shifting force cannot be secured, and the lateral shifting force (F'1) of the film 33 is applied to the second regulating unit 47L side. Then, as shown in FIG. 14, the first movable member 48 on the side opposite to the shifting direction moves to the second regulating unit 47L side following the lateral shift of the film 33. Here, in the fixing device of this embodiment, the first movable member 48 is regulated such that a predetermined distance Z at which the first movable member 48 does not overlap the end face of the pressure roller 32 is kept. As a result, the predetermined distance Z is secured between the regulating position of the first movable member 48 regulating the film 33 and the end position of the fixing nip portion N pressed by the pressure roller 32. Since the first movable member 48 and the fixing nip portion N do not overlap in the film generatrix direction, no stress concentration occurs in the film 33. Therefore, even when a lateral shifting three greater than expected is generated, breakage of the film 33 can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-189097 filed Sep. 28, 2017, which is hereby incorporated by reference herein in its entirety.

What is claimed is:

1. A fixing device comprising:

a tubular flexible member, wherein a lubricant is applied to an inner surface of the tubular flexible member;

a first regulating unit configured to regulating a lateral shift movement of the tubular flexible member in a generatrix direction of the tubular flexible member, the first regulating unit including a first movable member disposed so as to face a first end face of the tubular flexible member and a first urging member configured to urge the first movable member in the generatrix direction of the tubular flexible member, wherein the first movable member has a contact surface arranged to contact the first end face of the tubular flexible member, and an inner surface facing portion that is in contact with the inner surface of the tubular flexible member; and a second regulating unit configured to regulating a lateral shift movement of the tubular flexible member in the generatrix direction of the tubular flexible member, the second regulating unit including a second movable member disposed so as to face a second end face of the tubular flexible member and a second urging member configured to urge the second movable member in the generatrix direction of the tubular flexible member, wherein the second movable member has a contact surface arranged to contact the second end face of the tubular flexible member, and an inner surface facing portion that is in contact with the inner surface of the tubular flexible member, wherein the tubular flexible member is arranged to contact and convey a recording material bearing an unfixed image while the recording material is subjected to a fixing process, and wherein the first and second movable members are each urged toward the tubular flexible member by the first and second urging members so that the contact between the contact surfaces of the first and second movable members and the first and second end faces of the tubular flexible member are each maintained and so that amounts of overlap between the inner surface facing portions of the first and second movable members and the tubular flexible member in the generatrix direction of the tubular flexible member are maintained regardless of the lateral shift movement of the tubular flexible member.

2. The fixing device according to claim 1, wherein the first movable member and the second movable member are arranged to move upstream in a recording material conveying direction when pushed by the tubular flexible member due to the lateral shift movement of the tubular flexible member.

3. The fixing device according to claim 1, further comprising a heater arranged to contact the inner surface of the tubular flexible member.

4. The fixing device according to claim 3, further comprising a pressure roller configured to contact the tubular flexible member to form a fixing nip portion so as to nip and convey the recording material, wherein the fixing nip portion is formed by the heater and the pressure roller with the tubular flexible member therebetween.

5. An image forming apparatus comprising:

an image forming portion configured to form an unfixed image on a recording material; and the fixing device according to claim 1, configured to fix the unfixed image formed on the recording material to the recording material.

* * * * *